US010352537B2

(12) United States Patent
Li

(10) Patent No.: US 10,352,537 B2
(45) Date of Patent: Jul. 16, 2019

(54) LIGHTING APPARATUS

(71) Applicant: Zheyi Li, Ningbo (CN)

(72) Inventor: Zheyi Li, Ningbo (CN)

( * ) Notice: Subject to any disclaimer, the term of this patent is extended or adjusted under 35 U.S.C. 154(b) by 95 days.

(21) Appl. No.: 15/525,944

(22) PCT Filed: Nov. 10, 2015

(86) PCT No.: PCT/CN2015/094156

§ 371 (c)(1),
(2) Date: Aug. 9, 2017

(87) PCT Pub. No.: WO2016/074601

PCT Pub. Date: May 19, 2016

(65) Prior Publication Data

US 2018/0031214 A1 Feb. 1, 2018

(30) Foreign Application Priority Data

Nov. 10, 2014 (CN) ..... 2014 2 0667544 U

(51) Int. Cl.

| | |
|---|---|
| ***F21S 6/00*** | (2006.01) |
| ***F21S 8/08*** | (2006.01) |
| ***F21S 9/02*** | (2006.01) |
| ***F21S 9/04*** | (2006.01) |
| ***F21V 3/00*** | (2015.01) |
| ***F21V 3/06*** | (2018.01) |
| ***F21V 14/02*** | (2006.01) |
| ***F21V 15/01*** | (2006.01) |
| ***F21V 17/02*** | (2006.01) |

(Continued)

(52) U.S. Cl.

CPC ..... *F21V 21/14* (2013.01); *F21S 6/005* (2013.01); *F21S 8/086* (2013.01); *F21S 9/02* (2013.01); *F21S 9/04* (2013.01); *F21V 3/00* (2013.01); *F21V 14/02* (2013.01); *F21V 15/01* (2013.01); *F21V 17/02* (2013.01); *F21V 17/12* (2013.01); *F21V 17/18* (2013.01); *F21V 21/40* (2013.01); *F21V 23/04* (2013.01); *F21V 3/062* (2018.02); *F21W 2131/103* (2013.01); *F21W 2131/1005* (2013.01); *F21Y 2113/00* (2013.01)

(58) Field of Classification Search

CPC . F21V 21/14; F21V 3/00; F21V 14/02; F21V 15/01; F21V 17/02; F21V 17/12; F21V 17/18; F21V 21/40; F21V 23/04; F21S 6/005; F21S 8/086; F21S 9/02; F21S 9/04

USPC ..... 362/157

See application file for complete search history.

(56) References Cited

U.S. PATENT DOCUMENTS 3,585,915 A * 6/1971 Oki ..... G03B 1/66 362/3

4,528,618 A * 7/1985 Bitsch ..... F21S 6/003 362/220

(Continued)

*Primary Examiner* — Bryon T Gyllstrom

(74) *Attorney, Agent, or Firm* — Raymond Y. Chan; David and Raymond Patent Firm

(57) ABSTRACT

Provided is a lighting apparatus. The lighting apparatus comprises a lighting device. The lighting device comprises a first lamp body and a second lamp body. The first lamp body and the second lamp body comprise a first lamp and a second lamp respectively. The first lamp and the second lamp provide lighting when connected to a power source. The first lamp body and the second lamp body are oppositely disposed and can rotate relative to one another.

15 Claims, 14 Drawing Sheets

(51) Int. Cl.

| | |
|---|---|
| ***F21V 17/12*** | (2006.01) |
| ***F21V 17/18*** | (2006.01) |
| ***F21V 21/14*** | (2006.01) |
| ***F21V 21/40*** | (2006.01) |
| ***F21V 23/04*** | (2006.01) |
| ***F21W 131/10*** | (2006.01) |
| ***F21Y 113/00*** | (2016.01) |
| ***F21W 131/103*** | (2006.01) |

(56) References Cited

U.S. PATENT DOCUMENTS 5,278,735 A * 1/1994 Her ..... B60Q 7/02 362/397
5,424,931 A * 6/1995 Wheeler ..... F21S 6/006 362/249.1
5,890,793 A * 4/1999 Stephens ..... G03B 15/06 362/11
6,457,841 B1 * 10/2002 Lynch ..... F21L 4/045 362/197
7,121,688 B2 * 10/2006 Rempel ..... F21L 14/02 362/249.11
7,810,948 B2 * 10/2010 Ogashiwa ..... F21S 8/06 362/239
8,002,438 B2 * 8/2011 Ko ..... F21V 17/107 362/249.02
8,430,529 B2 * 4/2013 Christ ..... F21L 4/08 362/183
2008/0043457 A1 * 2/2008 Braxson ..... A47B 23/06 362/98
2010/0232147 A1 * 9/2010 Bryant ..... F21L 4/08 362/183
2011/0205752 A1 * 8/2011 Allen ..... F21V 15/01 362/555

* cited by examiner

A-A

B

C

LIGHTING APPARATUS

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

This invention relates to the field of illumination, and, in particular, to a lighting device, which lighting direction can be adjusted according to operational requirements, so as to enhance the convenience for the user to utilize the lighting device.

Description of Related Arts

The structures of lighting device according to prior art are relatively fixed. When the user feels like to use the lighting device for illumination, there could usually be inconvenient for the user due to the unadjustable illumination angle. For instance, when the user needs to carry a lighting device down the shaft or for working under severe environment, he would demand the carried lighting device to be not only easy to adjust the lighting direction so as for the user to observe the surrounding in all direction, but also portable because it is difficult and dangerous to move a lighting device with bulky and complex structure to a severe environment.

According to prior art, a person skilled in the art invented a mounting angle adjustable lighting device. The angle of the lighting device is adjustable during the installation of the device, but it can still illuminate toward only one direction after mounted. Another persons skilled in the art adjust the illumination angle of lighting device by means of adding foundation and support to the lighting device. However, the structures of such type of conventional designs are all very complex, rendering high purchase costs for the clients.

Moreover, conventional rotation angle adjustable devices usually allows the user to casually adjust it and lack of accurate positioning after adjustment that the weight of the device can change its illumination angle. For example, we usually share a similar experience in our daily life regarding stand fan that we usually casually turn the fan when turning the blowing angle of the fan and the fan may also change its blowing angle due to its own weight during its operation after turning.

Besides, conventional portable lighting device often lack of angle adjustment function. Those with added foundation and support become not only complex and more costly, but also inconvenient to carry with, which are not suitable for utilizing in the circumstances that require portable lighting device.

SUMMARY OF THE PRESENT INVENTION

An object of the present invention is to provide a lighting apparatus, wherein the lighting apparatus comprises a lighting device, wherein the illumination direction of the lighting device can be adjusted according to the actual needs.

An object of the present invention is to provide a lighting apparatus, wherein the illumination height of the lighting device can be adjusted according to the actual needs so as to enhance the illumination intensity for specific position.

An object of the present invention is to provide a lighting apparatus, wherein the lighting device is a portable device so as for the user to carry with.

An object of the present invention is to provide a lighting apparatus, wherein the lighting device utilizes direct current, such that it can illuminate anytime and anywhere as long as there is direct-current power source.

An object of the present invention is to provide a lighting apparatus, wherein the illumination intensity of the lighting device can be regulated according to the actual needs.

An object of the present invention is to provide a lighting apparatus, wherein the illumination direction of the lighting device can be adjusted in steps.

In order to achieve the above objects, the present invention provide a lighting apparatus, wherein the lighting apparatus comprises a lighting device. The lighting device comprises a first lamp body and a second lamp body. The first lamp body and the second lamp body comprise a first lamp and a second lamp respectively. The first lamp and the second lamp provide lighting when connected to a power source. The first lamp body and the second lamp body are oppositely arranged and rotatable relatively to each another.

Preferably, the first lamp body and the second lamp body respectively comprise a first lampshade and a second lampshade. The first lamp body is affixedly arranged in the first lampshade. The second lamp body is affixedly arranged in the second lampshade.

Further, the lighting apparatus comprises a bracing device. The lighting device is affixedly connected on the bracing device.

Preferably, the bracing device comprises at least a first regulator. The first regulator is arranged on the bracing device for adjusting the opening angle of the bracing device.

Specifically, the lighting device further comprises a holding device. The first lamp body and the second lamp body are respectively rotatably connected on the holding device.

Specifically, the holding device further comprises a holding portion and a connecting device. The first lamp body and the second lamp body are rotatably connected on the connecting device. The holding portion is extended from the connecting device so as to form a handle.

Preferably, the relative positions of the connecting device and the triangular support are fixed through a first screw.

Specifically, the shapes of the first lamp body and the second lamp body are identical. The first lamp body and the second lamp body are allowed to rotate to mutually overlapping positions.

Preferably, the first lampshade comprises a lug arranged thereon. The second lampshade comprises a buckle arranged thereon. When the first lamp body and the second lamp body are rotated to overlap, the lug and the buckle will be buckled with each other to lock the relative positions of the first lamp body and the second lamp body.

Preferably, the power source is a direct-current power source.

Specifically, the direct current power source is an accumulator.

Preferably, the holding device comprises a power switch button, a lighting level button, and a battery case arranged thereon. The accumulator is arranged in the battery case. The power switch button and the lighting level button are electrically connected with the accumulator.

Further, the first lamp body is rotatably connected with the connecting device through at least a first connecting unit.

The second lamp body is symmetrically rotatably connected with the connecting device through at least a second connecting unit.

Further, the first connecting unit comprises a first spline and a first spline socket. The first spline is fixedly attached on the first lamp body. The first spline socket is fixedly attached on the connecting device and engaged with the first spline. The second connecting unit comprises a second spline and a second spline socket. The second spline is fixedly attached on the second lamp body. The second spline socket is fixedly attached on the connecting device and engaged with the second spline. The first spline is movable in the first spline socket. The second spline is movable in the second spline socket.

Preferably, the supporting device and the lighting apparatus are allowed to rotate in relative angle through the engagement of a pair of engaging teeth. The engaging teeth comprise a first cog and a second cog. The first cog is fixedly attached on the lighting apparatus. The second cog is fixedly attached on the supporting device. The first cog and the second cog are fastened through a second screw.

All in all, the lighting apparatus according to the present invention not only allows accurately axially turning of the angle of the lighting device, but also allows changing of the height of the bracing device, such that the illumination angle of the lighting apparatus according to the present invention can be adjusted. Besides, the lighting apparatus according to the present invention also allows adjustment to the illumination direction of the lighting apparatus through adjusting the tilt angle between the lighting device and the bracing device. The user can conduct a single or combination adjustment to the lighting apparatus according to the present invention based on the on-site environment or the actual conditions so as to achieve the illumination demand.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
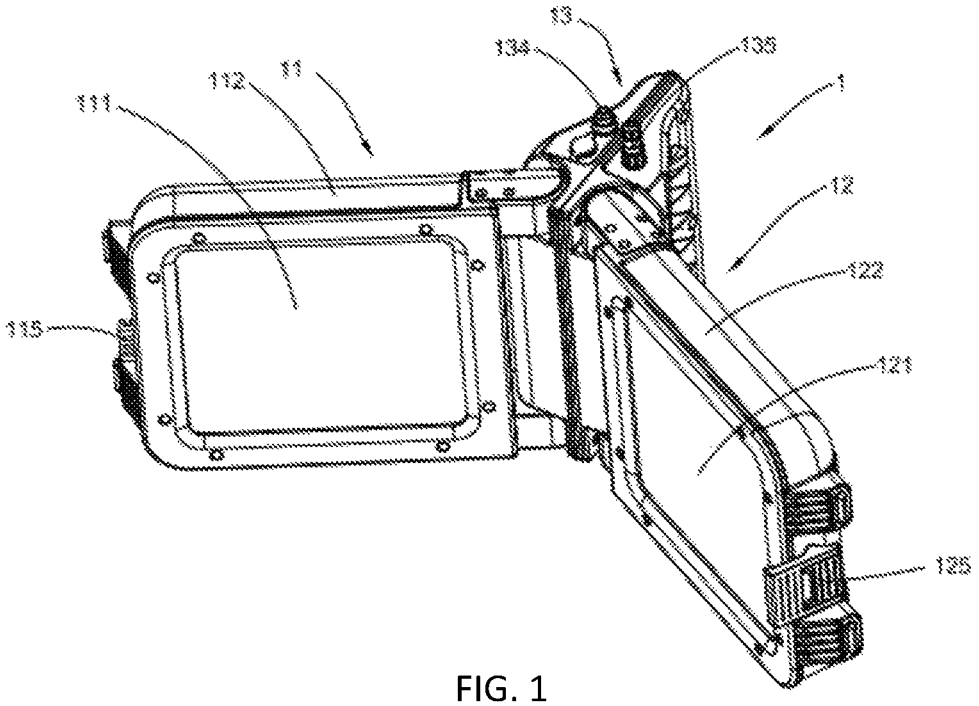
FIG. 1 is a 3D perspective view illustrating the lighting device of the lighting apparatus according to a first embodiment of the present invention rotated into obtuse angle.
Figure 2:
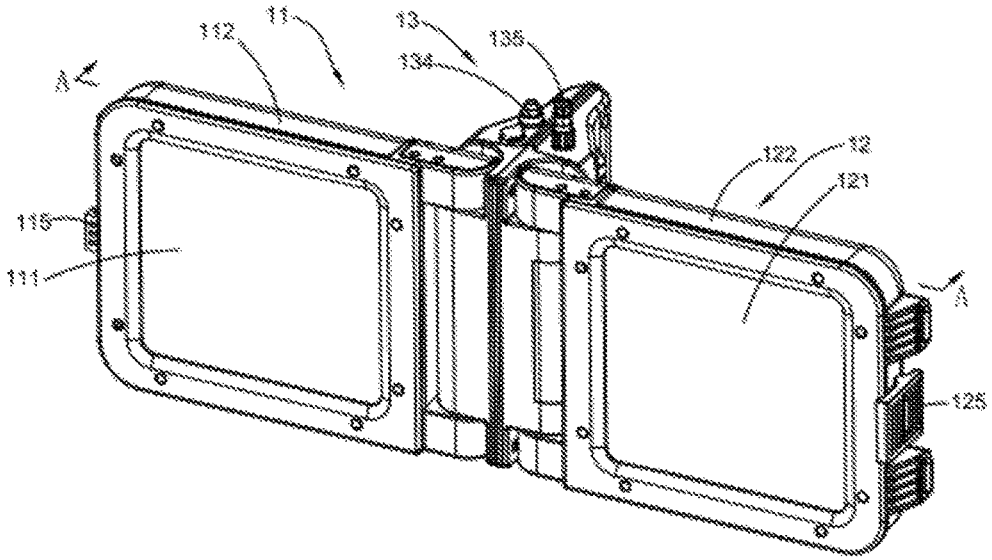
FIG. 2 is a 3D perspective view of the lighting device in FIG. 1 rotated to a plane.

Referring to FIGS. 1 and 2, the lighting apparatus according to the present invention comprises a lighting device 1. The lighting device 1 comprises a plurality of lamp bodies. In this embodiment, it comprises two lamp bodies, which are a first lamp body 11 and a second lamp body 12. The first lamp body 11 and the second lamp body 12 comprise a first lamp 111 and a second lamp respectively. The first lamp 111 and the second lamp 121 provide of lighting when connected to a power source. The first lamp body 11 and the second lamp body 12 are oppositely arranged and rotatable relatively to each another.

As an alternative of the lighting apparatus according to the present invention, person skilled in the art may also arrange to connect the first lamp body 11 and the second lamp body 12 with alternating current. The implementation of the present invention shall not be limited hereby.

Figure 3:
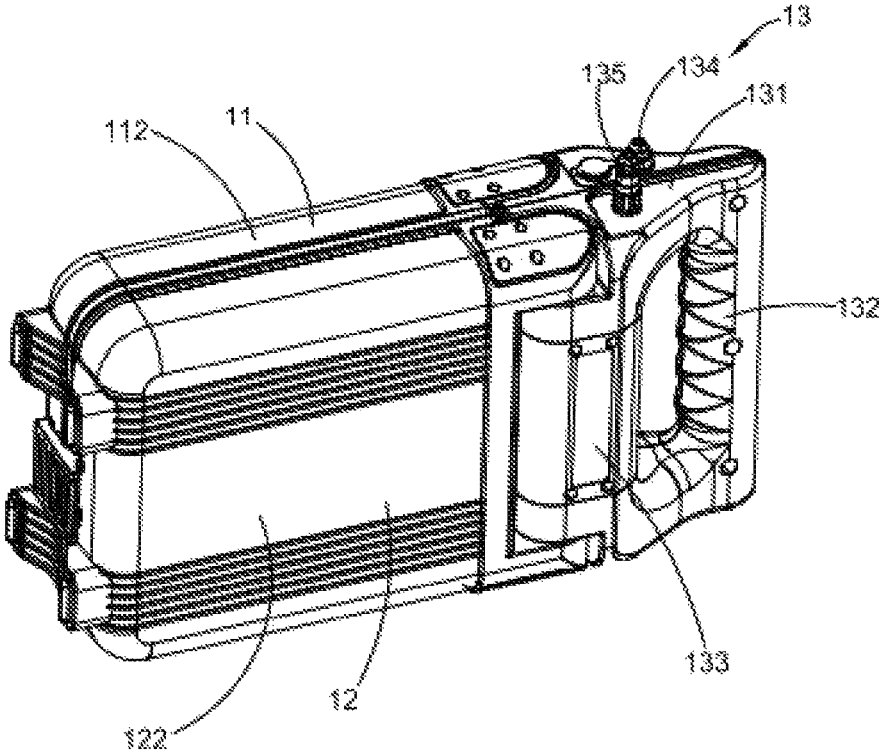
FIG. 3 is a 3D perspective view of the lighting device in FIG. 1 overlap.
Figure 4:
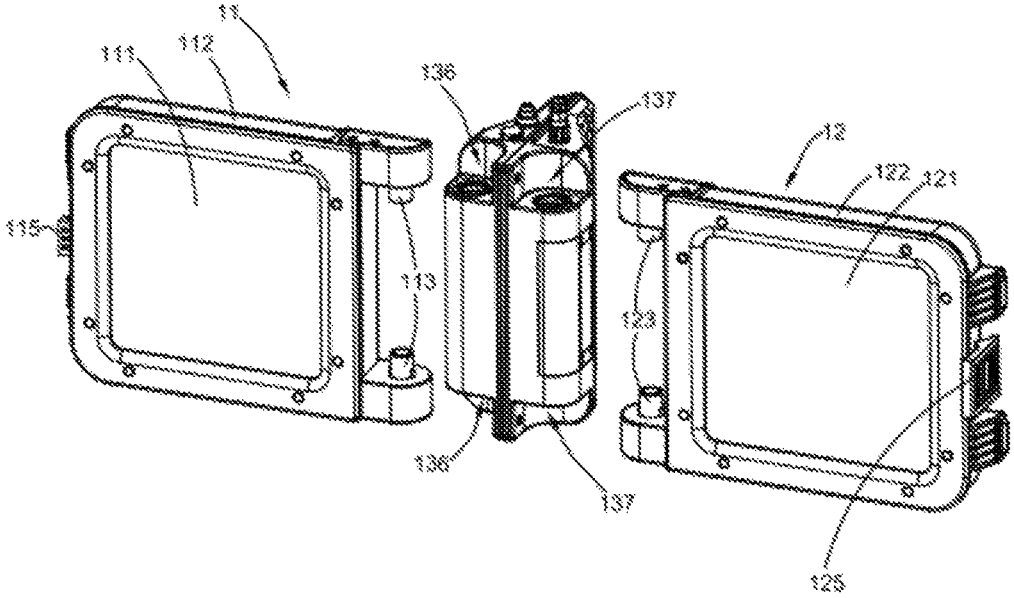
FIG. 4 is an exploded perspective view of the lighting device in FIG. 1.
Figure 5:
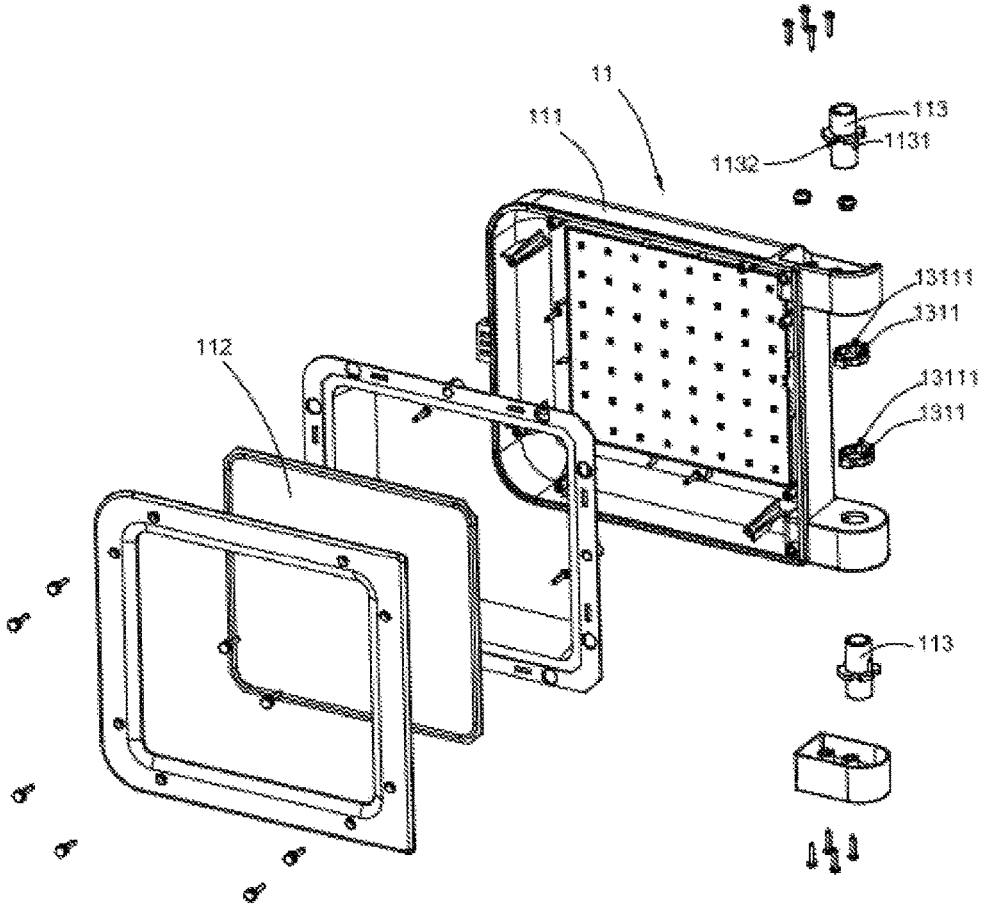
FIG. 5 is an exploded view of the first lamp body of the lighting device.
Figure 6:
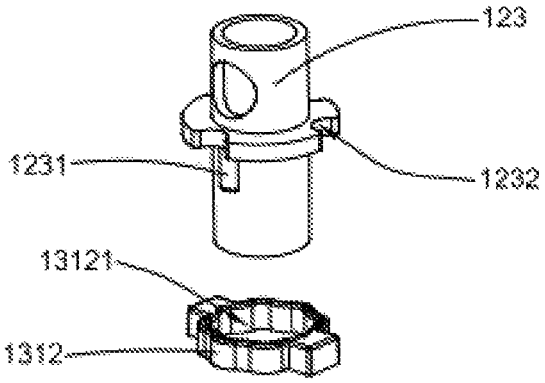
FIG. 6 is a partially enlarged exploded view of the first connecting unit in FIG. 5.

Referring to FIGS. 1-3, as a preferred embodiment of the lighting apparatus according to the present invention, the lighting device 1 further comprises a holding device 13. The holding device 13 is arranged between the first lamp body 11 and the second lamp body 12. Also, the first lamp body 11 and the second lamp body 12 are respectively rotatably connected on the holding device 13. Preferably, the holding device 13 comprises a holding portion 132 and a connecting device 131. The connecting device 13 and the first lamp body 11 and the second lamp body 12 are fixedly attached. The holding portion 132 is extended from the connecting device 131 so as to form a handle. Further, the connecting device 131 has a battery case 133 arranged therewith. The direct-current power source is an accumulator. The accumulator is arranged in the battery case 133 and electrically connected with the first lamp 111 and the second lamp 121. The dismountable direct-current power source facilitates the carrying, replacement, and transportation for the user, so as to further enhance the user-friendliness of the lighting apparatus according to the present invention. Furthermore, the handle has antiskid structure arranged thereon, which helps to prevent it from slipping and dropping when the user is holding it.

Preferably, the holding device 13 comprises a power switch button 134 and a lighting level button 135. The power switch button 134 and the lighting level button 135 are electrically connected with the direct-current power source, so as for people to adjust the light intensity and to turn on/off the first lamp 111 and the second lamp 121. More preferably, the power switch button 134 and the lighting level button 135 are arranged on the connecting device that will not hinder the user to hold the handle, but can facilitate the user to conduct controlling and adjustment to the power switch button 134 and the lighting level button 135 at any time based on the needs.

As an alternative of the lighting apparatus according to the present invention, person skilled in the art may also respectively arrange a power switch button 134 and a lighting level button 135 for the first lamp 111 and the second lamp 121 based on the needs, so as to respectively control the first lamp 111 and the second lamp 121, such that the user-friendliness of the lighting apparatus according to the present invention can be further enhanced.

Furthermore, referring to FIGS. 4-7, the two sides of the connecting device 131 comprise two first L-form grooves 136 and two second L-form grooves 137 respectively. The first lamp body 11 comprises two symmetrical first connecting units 113 affixedly arranged thereon. The first lamp body 11 is respectively connected in the first L-form grooves 136 of the connecting device 131 through the first connecting units 113. Also, the first lamp body 11 can bring the first connecting units 113 to rotate relatively to the connecting device 131. The second lamp body 12 comprises two symmetrical second connecting units 123affixedly arranged thereon. The second lamp body 12 is respectively connected in the second L-form grooves 137 of the connecting device 131 through the second connecting units 123. Correspondingly, the second lamp body 12 can bring the second connecting units 123 to rotate relatively to the connecting device 131.

Referring to FIG. 2, the installed first lamp body 11 and second lamp body 12 are on the same plane and both the first lamp body 11 and second lamp body 12 can freely rotate relatively to the connecting device 131 in opposite direction. The rotation angle can be, for example, between 0°-180°. In other words, the first lamp body 11 and the second lamp body 12 can rotate to the positions that they are both on the same plane. Besides, it can adjust the angle(s) of the first lamp body 11 and/or second lamp body 12 to a sharp angle, right angle or obtuse angle based on the needs, so as to meet the illumination demand of the user. When the user is carrying the lighting apparatus according to the present invention or does not need to utilize the lighting apparatus, he may rotate the first lamp body 11 and the second lamp body 12 to the overlapping positions. The first lamp body 11 further comprises a lug 115 thereon, while the second lamp body 12 also comprises a buckle 125 at the corresponding position. When the first lamp body 11 and the second lamp body 12 are rotated to overlap, it can utilize the lug 115 and the buckle 125 to buckle and lock the first lamp body 11 and the second lamp body 12. Therefore, it can not only provide a portable function, but also protect the first lamp 111 and the second lamp 121 of the first lamp body 11 and the second lamp body 12, which is to kill two birds with one stone. It is understandable that the two lamp bodies 11 and 12 can also be connected and fixed through other dismountable connection mode when they are attached.

As an alternative of the lighting device 1 of the lighting apparatus according to the present invention, the rotation angle of the first lamp body 11 and the second lamp body 12 may also be adjusted according to actual needs. Person skilled in the art only can implement a maximum change of the rotation angle through only conducting a simple adjustment on the structure of the connecting device 131. For instance, it can turn the L-form grooves of the connecting device 131 into a plane that the first lamp body 11 and the second lamp body 12 are respectively rotatably connected with the connecting device 131 on a plane, such that the first lamp body 11 and the second lamp body 12 will not be restricted by the L-form grooves of the lighting device 1 according to the above first embodiment of the present invention during rotation, so as to achieve a larger scale or even 360° rotation. Those adopt the same or similar technological means of the present invention and achieve the same or similar technological result are all within the claimed scope of the present invention, while the implementation of the present invention shall not be limited hereby.

Referring to FIGS. 4-9, further, any of the first connecting units 113 comprises a first spline 1131. The first spline sockets 1311 are the sockets of the connecting device 131 that respectively match the first connecting units 113. The first splines 1131 are adapted for each first concave portion 13111 in the first spline sockets 1311. When rotating the first lamp 111, the first lamp 111 brings the first spline 1131 on each first connecting unit 113 to slide along the first concave portion 13111 in the first spline socket 1311. For each rotation of the first lamp 111, the first spline 1131 on the first connecting unit 113 move for one scale in the first spline socket 1311 to enter the adjacent first concave portion 13111 in the spline socket and be positioned, so as to accomplish a fine adjustment and positioning of the angle of the first lamp 111, which helps the user to conduct adjustment based on the needs or actual conditions.

Correspondingly, any of the second connecting units 123 comprises a second spline 1231. The second spline sockets 1312 are the sockets of the connecting device 131 that respectively match the second connecting units 123. The second splines 1231 are adapted for each second concave portion 13121 in the second spline sockets 1312. When rotating the second lamp 121, the second lamp 121 brings the second spline 1231 on each second connecting unit 123 to slide along the second concave portion 13121 in the second spline socket 1312. Similarly, for each rotation of the second lamp 121, the second spline 1231 on the second connecting unit 123 move for one scale in the second spline socket 1312 to enter the adjacent second concave portion 13121 in the spline socket and be positioned, so as to accomplish the adjustment and positioning of the second lamp 121 for a precise angle, which helps the user to conduct adjustment based on the needs or actual conditions.

Figure 7:
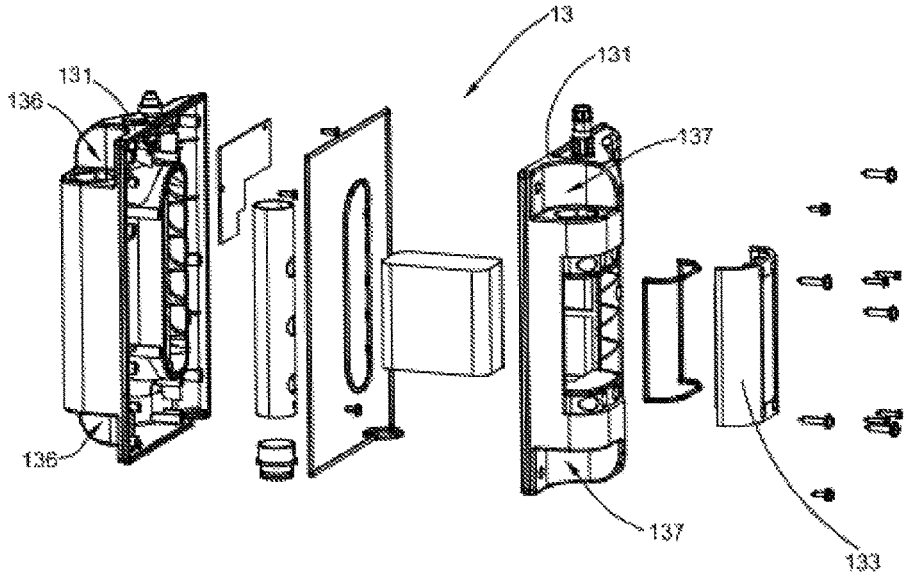
FIG. 7 is an exploded view of the holding device of the lighting device.

In other words, referring to FIGS. 7-9, the working principle of the rotation of the first lamp body 11 and the second lamp body 12 relative to the connecting device 131 is simply described as follows. When the first connecting unit 113 rotates along with the rotation of the first lamp body 11, the first spline 1131 of the first connecting unit 113 will shift in the first spline socket 1311. For each rotation of the first lamp body 11, the first spline 1131 of the first connecting unit 113 shifts for one scale in the first spline socket 1311, so as to achieve the rotation and positioning of the first lamp body 11 relative to the connecting device 131. Similarly, when the second connecting unit 123 rotates along with the rotation of the second lamp body 12, the second spline 1231 of the second connecting unit 123 will shift in the second spline socket 1312. For each rotation of the second lamp body 12, the second spline 1231 of the second connecting unit 123 shifts for one scale in the second spline socket 1312, so as to achieve the rotation and positioning of the second lamp body 12 relative to the connecting device 131.

In the above first embodiment of the present invention, the first spline 1131 of the first connecting unit 113, the first spline socket 1311 that is adapted to the first spline 1131, the second spline 1231 of the second connecting unit 123, and the second spline socket 1312 that is adapted to the second spline 1231 are all made of plastic material, so as to tolerate the pressing and distortion occurred when the first spline 1131 is turning in the first spline socket 1311 and when the second spline 1231 is turning in the second spline socket 1312.

Moreover, the first spline socket 1311 and the second spline socket 1312 can be integrally formed with the connecting device 131 or be separately arranged with the connecting device 131. Those adopt the same or similar technological means to the present invention and achieve the same or similar technological result are all within the claimed scope of the present invention, while the implementation of the present invention shall not be limited hereby.

Figure 8:
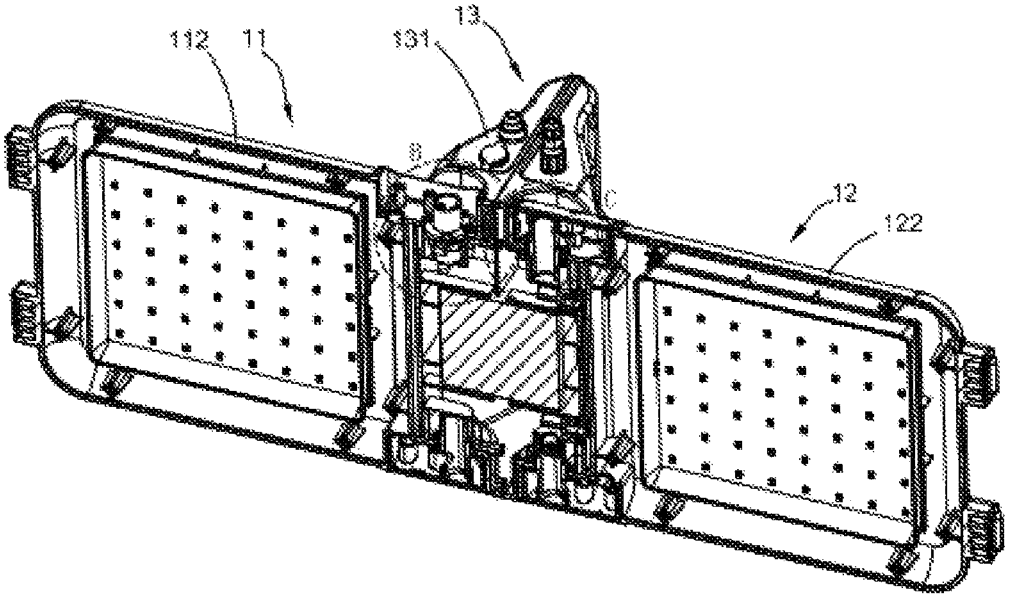
FIG. 8 is an A-A direction sectional perspective view of FIG. 2.
Figure 9:
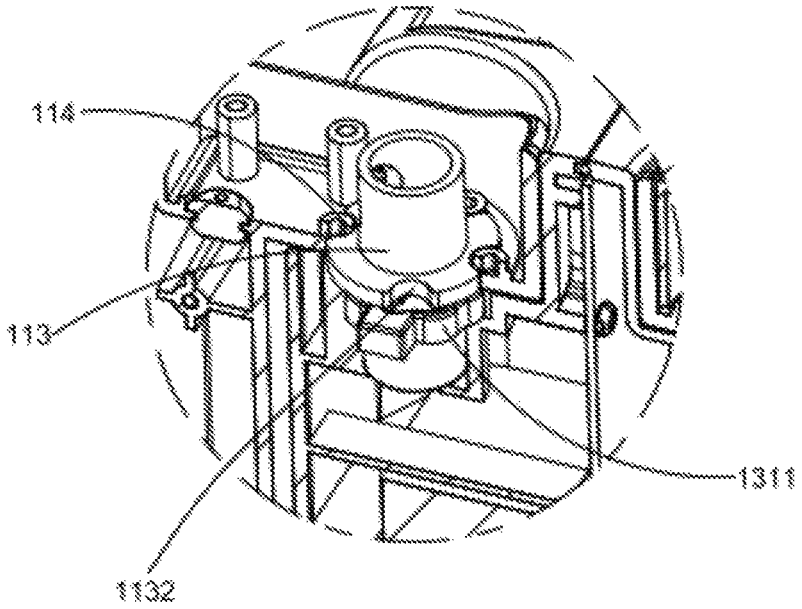
FIG. 9 is an enlarged perspective view of the portion B of FIG. 8.

Referring to FIG. 8, preferably, the first lamp body 11 comprises at least a first protruding 114. The periphery of the first connecting unit 113 comprises first groove(s) 1132 with the same quantity to the first protruding 114. The shapes of first protruding 114 and the first groove 1132 match inside of the first groove 1132. When the first lamp body 11 rotates, the first protruding 114 of the first lamp body 11 will bring the first connecting unit 113 to rotate along, so as to achieve the fixed attachment of the first lamp body 11 and the first connecting unit 113. Correspondingly, the second lamp body 12 comprises at least a second protruding 124. The periphery of the second connecting unit 123 comprises second groove(s) 1232 with the same quantity to the second protruding 124. The shapes of second protruding 124 and the second groove 1232 match inside of the second groove 1232. When the second lamp body 12 rotates, the second protruding 124 of the second lamp body 12 will bring the second connecting unit 123 to rotate along, so as to achieve the fixed attachment of the second lamp body 12 and the second connecting unit 123.

As an alternative of the present invention, the first connecting unit 113 and the first lamp body 11 and/or the second connecting unit 123 and the second lamp body 12 can also be fixedly attached or synchronized in motion through other ways. Therefore, those adopt the same or similar technological means to the present invention and achieve the same or similar technological result are all within the claimed scope of the present invention, while the implementation of the present invention shall not be limited hereby.

Person skilled in the art may also adjust the dimensions of the first spline 1131 and/or the second spline 1231 based on actual conditions and correspondingly adjust the dimensions of the concave portion(s) of the coordinated first spline socket 1311 and/or the coordinated second spline socket 1312. Those adopt the same or similar technological means to the present invention and achieve the same or similar technological result are all within the claimed scope of the present invention, while the implementation of the present invention shall not be limited hereby.

Further, the first lamp body 11 further comprises a first lampshade 112. The first lampshade 112 covers and fastens the first lamp 111, so as to keep the first lamp 111 safe. Further, the first lampshade 112 is preferably made of material that perform to moderate light, comprising PC materials and etc., so as to moderate the light emitted from the first lamp 111 in order to protect the user's eyes and prevent the user's eyes from being hurt by exposure to glare, especially at the moment when the first lamp 111 is just turned on.

Similarly, the second lamp body 12 further comprises a second lampshade 122. The second lampshade 122 covers and fastens the second lamp 121, so as to keep the second lamp 121 safe. Further, the second lampshade 122 is preferably made of material that perform to moderate light, comprising PC materials and etc., so as to moderate the light emitted from the second lamp 121 in order to protect the user's eyes and prevent the user's eyes from being hurt by glare dazzling, especially at the moment when the second lamp 121 is just turned on.

Figure 10:
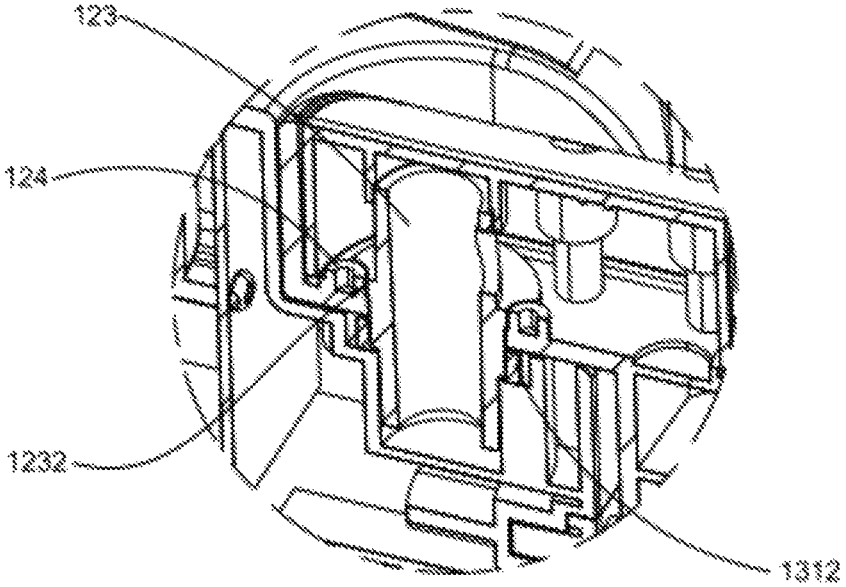
FIG. 10 is an enlarged perspective view of the portion C of FIG. 8.
Figure 11:
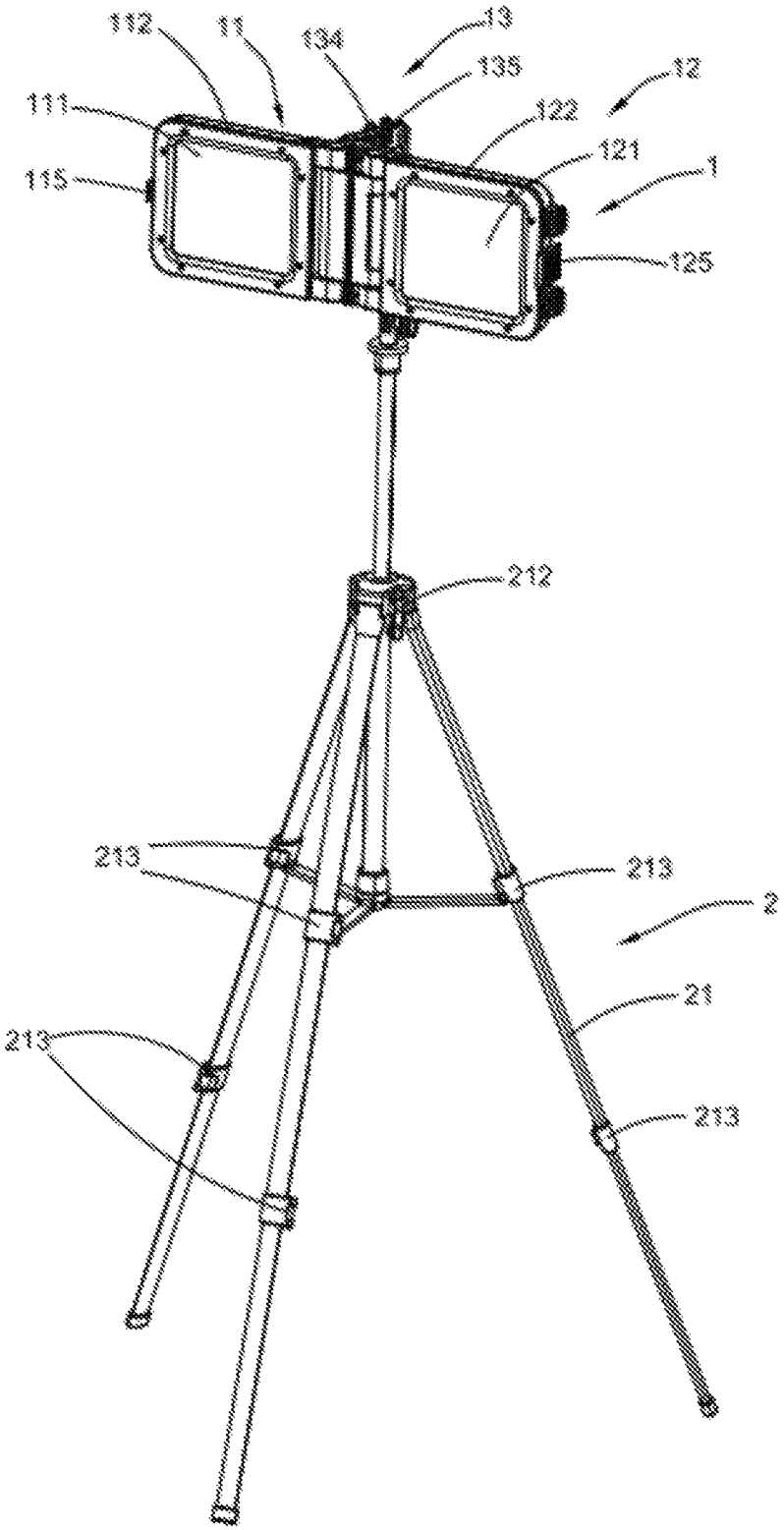
FIG. 11 is a 3D perspective view illustrating a state of the lighting apparatus according to a first embodiment of the present invention.
Figure 12:
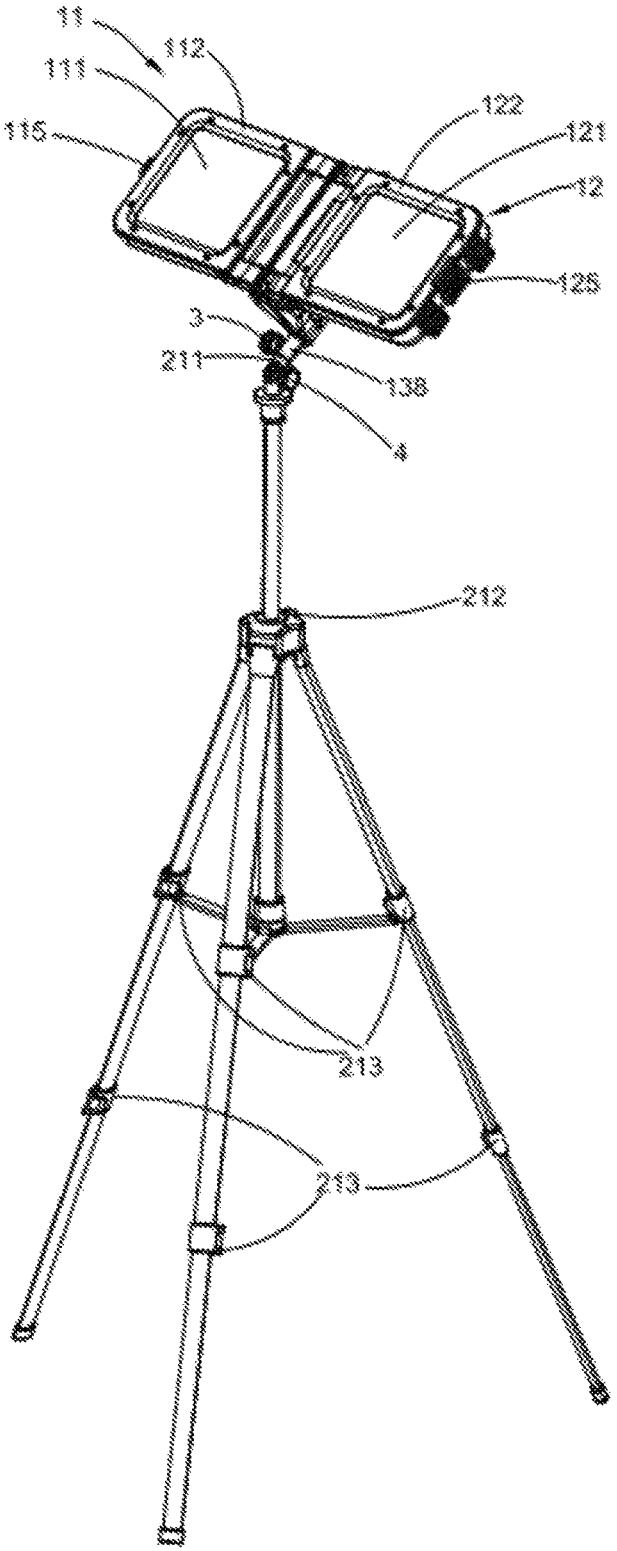
FIG. 12 is a 3D perspective view illustrating another state of the lighting apparatus according to the above first embodiment of the present invention.
Figure 13:
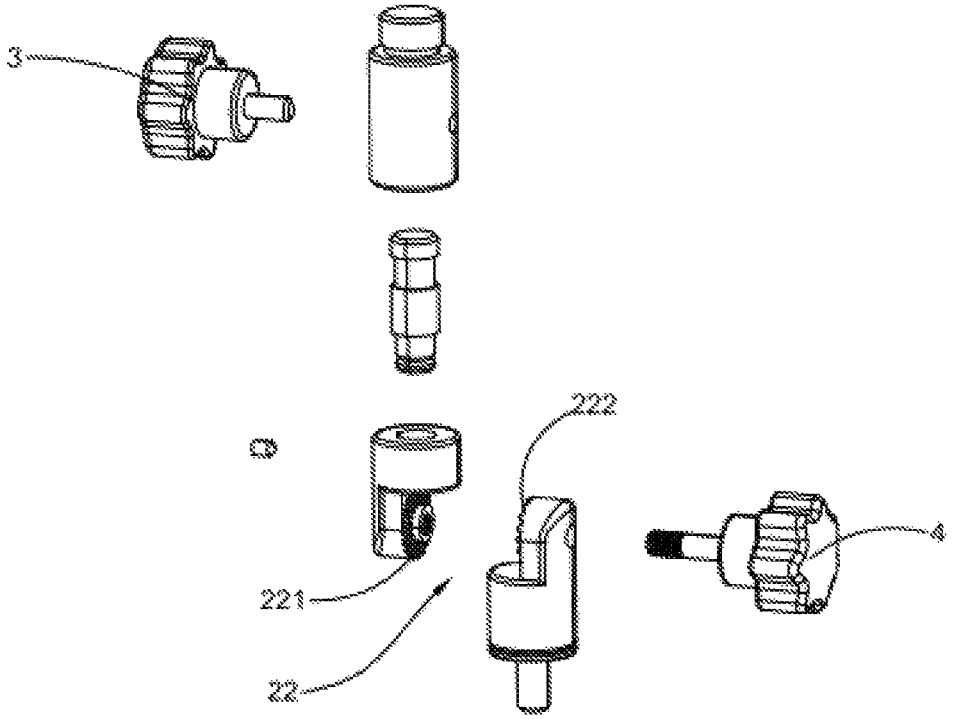
FIG. 13 is an enlarged exploded view of the engaging teeth in FIG. 12.

Referring to FIGS. 10-12, the lighting apparatus of the present invention further comprises a bracing device 2 for supporting the lighting device 1 and providing a stable position for the lighting device 1. Preferably, the bracing device 2 is a triangular support 21. The holding device 13 comprises a rabbet 138 arranged on the lower portion thereof.

The shape of the top portion 211 of the triangular support 21 and the shape of the rabbet 138 are identical and the outer diameter of the top portion 211 of the triangular support 21 is slightly smaller than the inner diameter of the rabbet 138, such that the rabbet 138 and the top portion 211 of the triangular support 21 are in clearance fit. Therefore, it facilitates the top portion 211 of the triangular support 21 to insert into the rabbet 138 arranged on the holding portion 132. Then the lighting device 1 and the bracing device 2 are fastened through a first screw 3, such that the lighting device 1 is stably positioned on the triangular support 21. In the above first embodiment of the present invention, the rabbet 138 and the top portion 211 of the triangular support 21 are both round. However, the implementation of the present invention shall not be limited hereby. Person skilled in the art may arrange the rabbet 138 and the top portion 211 of the triangular support 21 into other shape, comprising lozenge and etc., according to the needs. Therefore, those adopt the same technological means to the present invention and achieve the same or similar technological result are all within the claimed scope of the present invention.

Referring to FIGS. 10 and 11, in the above first embodiment of the present invention, the triangular support 21 is a multistage adjustable structure. The triangular support 21 comprises a first regulator 212 that is able to regulate opening degree and at least a set (a set is three pieces) of second regulators 213 for regulating the height of the triangular support 21. Therefore, the user can employ the first regulator 212 and the second regulators 213 to regulate the height and opening degree of the triangular support 21 according to actual needs, so as to ensure the position of the lighting device 1 meets the illumination demand of the user. In other words, the lighting apparatus of the present invention can not only be independently carried and utilized with the holding portion 132, but also be utilized in a stationary manner through placing on the triangular support 21. The user may decide the specific usage mode based on actual needs. The specific usage mode of the lighting apparatus according to the present invention shall not be limited.

Referring to FIG. 12, furthermore, in the above first embodiment of the lighting apparatus according to the present invention, the tilt angle of the lighting device 1 relative to the triangular support 21 can also be adjusted. The triangular support 21 comprises a pair of engaging teeth 22 thereon. The rotation direction of the engaging teeth 22 is perpendicular to the rotation directions of the first lamp body 11 and the second lamp body 12. The engaging teeth 22 comprises a first cog 221 and a second cog 222. The first cog 221 is attached on the lighting device 1 through the first screw 3. The second cog 222 is affixedly arranged on the triangular support 21. The first cog 221 and the second cog 222 are engaged and fastened through a second screw 4. When the second screw 4 is released, the distance between the first cog 221 and the second cog 222 can be increased, so as to rotate the lighting device 1 to change the engaging position of the first cog 221 and the second cog 222. When the lighting device 1 is adjusted to an appropriate tilt angle, it can utilize the second screw 4 to engage and fasten the first cog 221 and the second cog 222 again, so as to fix the lighting device 1 on the triangular support 21. Person skilled in the art may change each angle of adjustment of the lighting apparatus through changing the interval angle of the first cog 221 and the second cog 222, while the protection scope of the present invention shall not be limited hereby.

Hence, the lighting apparatus according to the present invention is able to not only adjust the precise illumination angle of the first lamp body 11 and the second lamp body 12 from lateral position, but also adjust the precise illumination angle of the first lamp body 11 and the second lamp body 12 from vertical position. Besides, it can accurately position after each of adjustment of the illumination angle, so as to enhance the convenience for the user to utilize the lighting device.

As an alternative of the lighting apparatus of the present invention, person skilled in the art may implement the lighting device 1 according to the present invention through assembling a plurality of the first lamp bodies 11/second lamp bodies 12 and the holding device 13 based on the client's needs or actual conditions. However, the implementation of the present invention shall not be limited hereby. Those adopt the same or similar technological means to the present invention and achieve the same or similar technological result are all within the claimed scope of the present invention.

All in all, the lighting apparatus according to the present invention not only allows accurately axially turning of the angle of the lighting device 1, but also allows changing of the height of the bracing device 2, such that the illumination angle of the lighting apparatus according to the present invention can be adjusted. Besides, the lighting apparatus according to the present invention also allows adjustment to the illumination direction of the lighting apparatus through adjusting the tilt angle between the lighting device 1 and the bracing device 2. The user can conduct a single or combination adjustment to the lighting apparatus according to the present invention based on the on-site environment or the actual conditions so as to achieve the illumination demand.

Figure 14:
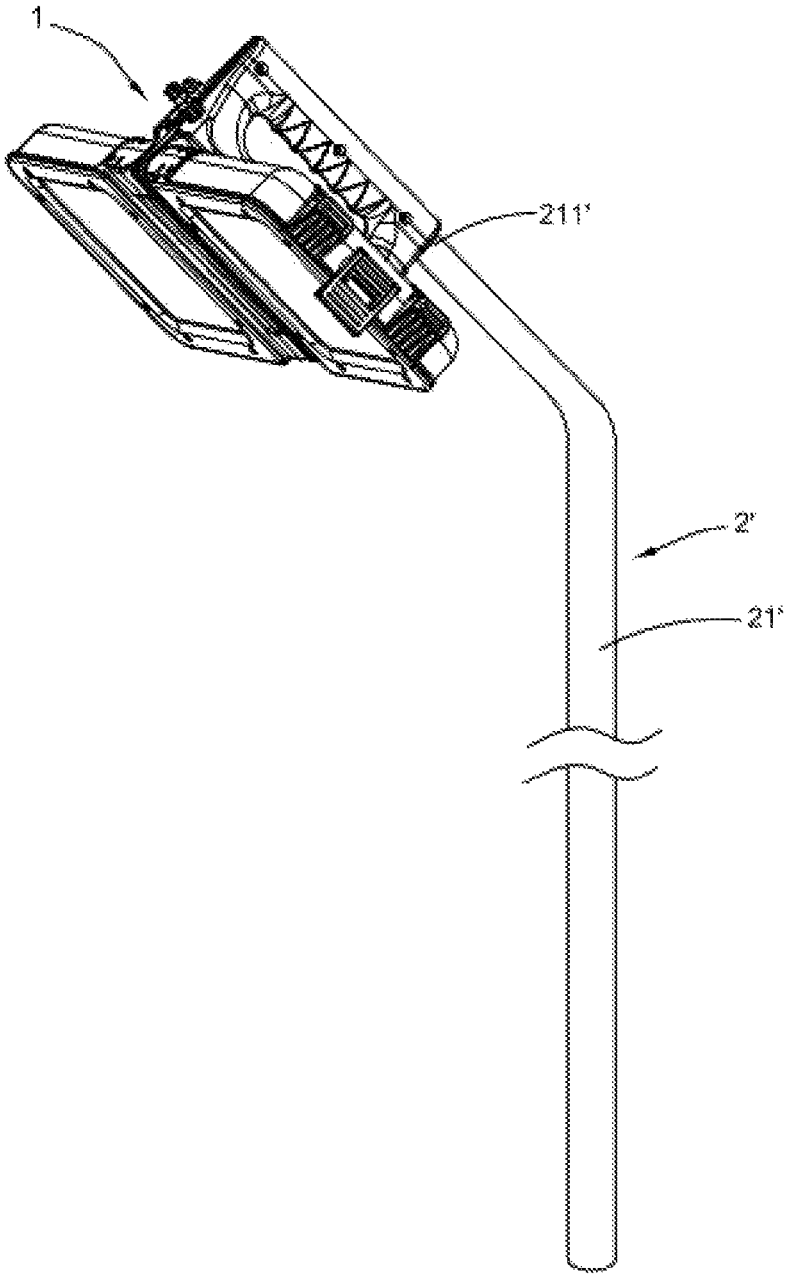
FIG. 14 is an alternative implement of the lighting apparatus according to the above first embodiment of the present invention.

FIG. 14 illustrated an alternative implement of the lighting apparatus according to the above first embodiment of the present invention. In the present embodiment, the bracing device 2' is a lamp post 21'. The rabbet 138 on the lower portion of the holding device 13 has the top portion 211' of the lamp post 21' inserted therein, such that the lighting apparatus of the present invention is turned into a pilot lamp standing by the roadside or intersection. When people travel by night or in severe weather or lose direction of traveling, it can employ the lighting apparatus according to the present embodiment as pilot lamp to provide light or tell/indicate traveling direction for people. Correspondingly, the two lamp bodies can be structured to provide the same light or different lights, so as to provide pilot signal.

Person skilled in the art may conduct other forms of alternatives to the types and applications of the lighting apparatus according to the present invention based on actual needs. For example, it can turn the lighting apparatus according to the present invention into stage equipment or apply the lighting apparatus according to the present invention for navigation beacon, and etc. Therefore, those adopt the same or similar technological means to the present invention and achieve the same or similar technological result are all within the claimed scope of the present invention, while the implementation of the present invention shall not be limited hereby.

Person skilled in the art shall understand that the above-mentioned embodiments of the present invention in the descriptions and figures are to give examples, but to confine the present invention. Objectives of the present invention are completely and effectively implemented. Notions of the functions and structures of the present invention have been shown and described in the embodiments, whereas implementations of the present invention may have modifications or changes in any ways without going against the above notions.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A lighting apparatus, comprising a lighting device, wherein said lighting device comprises a first lamp body and a second lamp body, wherein said first lamp body and said second lamp body comprise a first lamp and a second lamp respectively, wherein said first lamp and said second lamp provide lighting when connected to a power source, wherein said first lamp body and said second lamp body are oppositely disposed and rotatable relatively to each another, wherein said lighting apparatus further comprises a bracing device which is a support comprising a pair of engaging teeth rotatably engaging said lighting device with said bracing device so as to adjust a tilt angle between said lighting device and said bracing device, wherein a rotation direction of said pair of engaging teeth is perpendicular to a rotation direction of said first lamp body and said second lamp body.

2. The lighting apparatus, as recited in claim 1, wherein said first lamp body and said second lamp body respectively comprise a first lampshade and a second lampshade, wherein said first lamp body is affixedly arranged in said first lampshade, wherein said second lamp body is affixedly arranged in said second lampshade.

3. The lighting apparatus, as recited in claim 2, wherein said lighting device further comprises a holding device, wherein said first lamp body and said second lamp body are respectively rotatably connected on said holding device.

4. The lighting apparatus, as recited in claim 2, wherein the shapes of said first lamp body and said second lamp body are identical, wherein said first lamp body and said second lamp body are allowed to rotate to mutually overlapping positions.

5. The lighting apparatus, as recited in claim 4, wherein said first lampshade comprises a lug arranged thereon, wherein said second lampshade comprises a buckle arranged thereon, wherein when said first lamp body and said second lamp body are rotated to overlap, said lug and said buckle will be buckled with each other to lock the relative positions of said first lamp body and said second lamp body.

6. The lighting apparatus, as recited in claim 1, wherein said bracing device comprises at least a first regulator, wherein said first regulator is arranged on said bracing device for adjusting the opening angle of said bracing device.

7. The lighting apparatus, as recited in claim 1, wherein said bracing device comprises at least a second regulator, wherein said second regulator is arranged on said bracing device of for adjusting the height of said bracing device.

8. The lighting apparatus, as recited in claim 1, wherein said lighting device further comprises a holding device, wherein said first lamp body and said second lamp body are respectively rotatably connected on said holding device.

9. The lighting apparatus, and recited in claim 8, wherein said holding device further comprises a holding portion and a connecting device, wherein said first lamp body and said second lamp body are rotatably connected on said connecting device, wherein said holding portion is extended from said connecting device so as to form a handle.

10. The lighting apparatus, as recited in claim 9, wherein said first lamp body is rotatably connected with said connecting device through at least a first connecting unit, wherein said second lamp body is symmetrically rotatably connected with said connecting device through at least a second connecting unit.

11. The lighting apparatus, as recited in claim 10, wherein said first connecting unit comprises a first spline and a first spline socket, wherein said first spline is fixedly attached on said first lamp body, wherein said first spline socket is fixedly attached on said connecting device and engaged with said first spline, wherein said second connecting unit comprises a second spline and a second spline socket, wherein said second spline is fixedly attached on the second lamp body, wherein said second spline socket is fixedly attached on said connecting device and engaged with said second spline, wherein said first spline is movable in said first spline socket, wherein said second spline is movable in said second spline socket.

12. The lighting apparatus, as recited in claim 9, wherein said bracing device is a triangular support, wherein the relative positions of said connecting device and said triangular support are fixed through a first screw.

13. The lighting apparatus, as recited in claim 1, wherein the shapes of said first lamp body and said second lamp body are identical, wherein said first lamp body and said second lamp body are allowed to rotate to mutually overlapping positions.

14. The lighting apparatus, as recited in claim 1, wherein the power source is a direct-current power source.

15. The lighting apparatus, as recited in claim 1, wherein said bracing device and said lighting device are allowed to rotate in relative angle through the engagement of a pair of engaging teeth, wherein said engaging teeth comprise a first cog and a second cog, wherein said first cog is fixedly attached on said lighting device, wherein said second cog is fixedly attached on said bracing device, wherein said first cog and said second cog are fastened through a second screw.

* * * * *